US007008875B2

(12) United States Patent
Birang et al.

(10) Patent No.: US 7,008,875 B2
(45) Date of Patent: Mar. 7, 2006

(54) METHODS AND APPARATUS FOR POLISHING CONTROL

(75) Inventors: Manoocher Birang, Los Gatos, CA (US); Konstantin Y. Smekalin, Pleasanton, CA (US); David A. Chan, Sunnyvale, CA (US)

(73) Assignee: Applied Materials Inc., Santa Clara, CA (US)

( * ) Notice: Subject to any disclaimer, the term of this patent is extended or adjusted under 35 U.S.C. 154(b) by 0 days.

(21) Appl. No.: 10/721,769

(22) Filed: Nov. 24, 2003

(65) Prior Publication Data

US 2004/0166685 A1 Aug. 26, 2004

Related U.S. Application Data

(60) Provisional application No. 60/428,569, filed on Nov. 22, 2002.

(51) Int. Cl.
*H01L 21/302* (2006.01)
*H01L 21/461* (2006.01)

(52) U.S. Cl. ..... 438/692; 438/740

(58) Field of Classification Search ..... 438/692, 438/697, 698, 690, 691, 740, 905, 906
See application file for complete search history.

(56) References Cited

U.S. PATENT DOCUMENTS

| | | | | |
|---|---|---|---|---|
| 5,081,796 | A | 1/1992 | Schultz | |
| 5,486,129 | A | 1/1996 | Sandhu et al. | |
| 5,658,183 | A | 8/1997 | Sandhu et al. | |
| 5,722,875 | A | 3/1998 | Iwashita et al. | |
| 5,730,642 | A | 3/1998 | Sandhu et al. | |
| 5,741,070 | A | 4/1998 | Moslehi | |
| 5,773,316 | A | 6/1998 | Kurosaki et al. | |
| 5,840,614 | A | 11/1998 | Sim et al. | |
| 5,985,094 | A | 11/1999 | Mosca | |
| 6,159,073 | A | 12/2000 | Wiswesser et al. | |
| 6,261,152 | B1 | 7/2001 | Aiyer | |
| 6,413,145 | B1 * | 7/2002 | Pinson et al. | 451/5 |
| 6,422,927 | B1 | 7/2002 | Zuniga | |
| 6,829,054 | B1 * | 12/2004 | Stanke et al. | 356/601 |
| 6,857,947 | B1 * | 2/2005 | Wang et al. | 451/296 |
| 2001/0015811 | A1 | 8/2001 | Ravid et al. | |
| 2001/0026364 | A1 | 10/2001 | Ravid et al. | |
| 2002/0005957 | A1 | 1/2002 | Moshe et al. | |

FOREIGN PATENT DOCUMENTS

| | | | |
|---|---|---|---|
| DE | 3801969 | A | 7/1989 |
| EP | 0879678 | A | 11/1998 |
| EP | 0904895 | A | 3/1999 |

(Continued)

OTHER PUBLICATIONS

International Search Report, International Application No.: PCT/US03/37337, Apr. 19, 2004, pp. 1-2.

(Continued)

*Primary Examiner*—David Nhu
(74) *Attorney, Agent, or Firm*—Fish & Richardson

(57) ABSTRACT

A CMP station can be closed loop controlled by using data obtained by an inline metrology station from a first polished wafer to affect the processing of subsequent polished wafers. The first wafer is polished and measured by the inline metrology station. The metrology station measures at various points the array dielectric thickness, field dielectric thickness, barrier residue thickness and metal residue thickness. The data is then inputted into an algorithm and polishing parameter outputs are calculated. The outputs are sent to the CMP station and used to supplement or replace the previous polishing parameters. Subsequent wafers are polished on the CMP station using the revised polishing parameters.

26 Claims, 5 Drawing Sheets

FOREIGN PATENT DOCUMENTS

WO WO99/25520 5/1999

OTHER PUBLICATIONS

Wijekoon et al., "Minimization of Metal Loss during Chemical Mechanical Planerization of Copper-Oxide and Copper—Low κ Damascene Structures", Mar. 2002, Santa Clara, CA, 4 pp.

Ravid et al., "Copper CMP Planarity Control Using ITM", 2000, Rehovoth, Israel, 7 pp.

Pan et al., "Copper CMP and Process Control", Final Paper submitted to CMP-MIC Conference, Feb. 11-12, 1999, Santa Clara, CA and Cambridge, MA, 7 pp.

Zhang et al., "Automated Process Control of Within-Wafer and Wafter-to-Wafer Uniformity in Oxide CMP", Mar. 2002, Santa Clara, CA, 6 pp.

* cited by examiner

METHODS AND APPARATUS FOR POLISHING CONTROL

CROSS-REFERENCE TO RELATED APPLICATIONS

This application claims priority to U.S. Provisional Application Ser. No. 60/428,569, filed on Nov. 22, 2002, the entire contents of which is incorporated herein by reference.

BACKGROUND

This invention relates generally to chemical mechanical polishing (CMP) of wafers, and more particularly to the closed loop control of a CMP station using data from an inline metrology device.

A challenging and necessary step in wafer processing is planarization of the wafer's surface after forming a layer of the integrated circuit. Fabricating integrated circuits on a wafer can begin with etching the wafer's dielectric material to create a patterned surface. In the trenches of the dielectric patterns is where the conductive features will be formed. A conductive material, such as copper, is then layered over the patterned surface. This step of layering copper onto the patterned surface of the wafer creates an irregular wafer profile. The wafer must be planarized to eliminate metal residue on the dielectric so that no current leakage occurs. Further, if a subsequent layer of the integrated circuit is to be formed, the wafer's surface must be sufficiently planar. One method of planarizing the wafer surface is by using CMP.

A CMP station mounts the wafer at a polishing station and polishes the wafer by moving it across or around a polishing pad. A polishing slurry is used in conjunction with the pad. The slurry contains at least one chemically-reactive agent and can contain abrasive particles. The CMP station can house multiple polishing stations. Each polishing station can employ distinct polishing parameters, conditions, and techniques such as polishing slurries, pad surfaces, applied pressures, polishing time, and metrology devices. In some CMP stations, the first polishing station polishes down the copper layer. The subsequent polishing stations then polish away the barrier material and any copper that is not part of the copper features of the integrated circuit. Underpolishing the wafer leaves copper and barrier material on the dielectric of the wafer and leads to current leakage. Overpolishing wears away too much of the copper features increasing resistance and nonuniform conductivity of the integrated circuits.

SUMMARY

This invention is directed to the closed loop control of a CMP station by using data obtained by an inline metrology station from a first polished wafer to affect the processing of subsequent polished wafers. The first wafer is polished and measured by the inline metrology station. The metrology station measures at various points the array dielectric thickness and the field dielectric thickness. The data is then inputted into an algorithm and polishing parameters are calculated. The parameters are sent to the CMP station and used to supplement or replace the previous polishing parameters. Subsequent wafers are polished on the CMP station using the revised polishing parameters.

In general, in one aspect, the invention features methods for closed loop control in chemical mechanical polishing using an inline metrology station. A dielectric thickness in an array of a first wafer from a plurality of wafers is measured at a metrology station. At least one polishing parameter from the dielectric thickness in the array of the first wafer is determined. A subsequent wafer from the plurality of wafers is polished using the polishing parameter.

In another aspect, metal feature thicknesses at multiple points across a first wafer are measured. At least one polishing parameter is calculated using the measurements of the metal feature thicknesses of the first wafer that approximates an optimal solution under a plurality of constraints with reference to which a predicted metal feature thickness uniformity is maximized in a subsequent wafer from the plurality of wafers. The subsequent wafer is polished from the plurality of wafers using the at least one polishing parameter.

In yet another aspect, a first wafer from a plurality of wafers is polished on a chemical mechanical polishing apparatus using a set of polishing parameters. The profile of the first polished wafer is measured at a metrology station, the profile including at least a first measurement of dielectric thickness in a first array, a second measurement of dielectric thickness in a second array, a first measurement of dielectric thickness in a first field, and a second measurement of dielectric thickness in a second field. The first array is proximate to the first field and the second field is proximate to the second array. A first erosion measurement and a second erosion measurement are determined, where the first erosion measurement is a difference between the first dielectric thickness in the first field and the first dielectric thickness in the first array and the second erosion measurement is a difference between the second dielectric thickness in the second field and the second dielectric thickness in the second array. A new polishing parameter is calculated from the measurement of the profile of the first wafer using the first and second dielectric thicknesses in the first and second arrays and the first and second erosion measurements. The new polishing parameter is communicated to the chemical mechanical polishing apparatus. The new polishing parameter is used to polish a subsequent wafer.

In still another method, a first dielectric thickness in a first array of a first wafer is measured at a metrology station. A second dielectric thickness in a second array of the first wafer is measured at the metrology station. The first and second dielectric thicknesses are passed from the metrology station to a controller. In the controller, at least one polishing parameter is determined in the controller using the first and second dielectric thicknesses. A subsequent wafer is polished with the at least one polishing parameter.

In yet another method, metal residue and barrier material residue on a first wafer are measured. The metal residue and the barrier material residue are located on field dielectric material, array dielectric material and metal features. At least one polishing parameter is calculated using the metal residue and the barrier material residue measurements, where the at least one polishing parameter ensures complete removal of the metal residue and the barrier material residue in a second wafer. The second wafer is polished using the at least one polishing parameter.

In another method, at a metrology station metal feature thicknesses are measured at multiple points across a first wafer of a plurality of wafers. At least one polishing parameter is calculated using the measurements of the metal feature thicknesses of the first wafer. The polishing parameter approximates an optimal solution under a plurality of constraints with reference to which a difference between a predicted metal feature thickness and a target metal feature thickness is minimized. A subsequent wafer is polished from the plurality of wafers using the at least one polishing parameter.

And in another method, a barrier layer residue thickness of a first substrate from a plurality of substrates is measured at a metrology station. At least one polishing parameter is determined from the barrier layer residue thickness of the first substrate. A subsequent substrate from the plurality of substrates is polished using the polishing parameter.

In another method, a first substrate from a plurality of substrates is polished on a chemical mechanical polishing apparatus using a set of polishing parameters. The profile of the first polished substrate is measured at a metrology station, the profile including at least one measurement selected from the group consisting of a measurement of dielectric thickness in an array and a measurement of barrier layer residue thickness. A new polishing parameter is determined from the measurement of the profile of the first substrate. The new polishing parameter is communicated to the chemical mechanical polishing apparatus. The new polishing parameter is used to polish a subsequent substrate.

In yet another method, a metal feature thickness in an array of a first substrate from a plurality of substrates is measured at a metrology station. At least one polishing parameter is determined from the metal feature thickness in the array of the first substrate. A subsequent substrate from the plurality of substrates is polished using the polishing parameter.

Particular implementations can include one or more of the following features. Inputting the array dielectric thickness and field dielectric thickness into an algorithm calculates polishing parameters that control wafer planarization and conductive uniformity. The residue thickness data can be used to eliminate residue on subsequent wafers. The array dielectric thickness is proportional to the copper feature thickness. Copper feature thickness is proportional to copper feature conductivity. To form a uniform conductivity profile on a wafer, the copper features must be of uniform thickness. In one implementation, the thickness of the copper features is not directly measured, but measuring the array dielectric thickness directly gives an indirect measurement of the copper feature thickness and conductivity.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
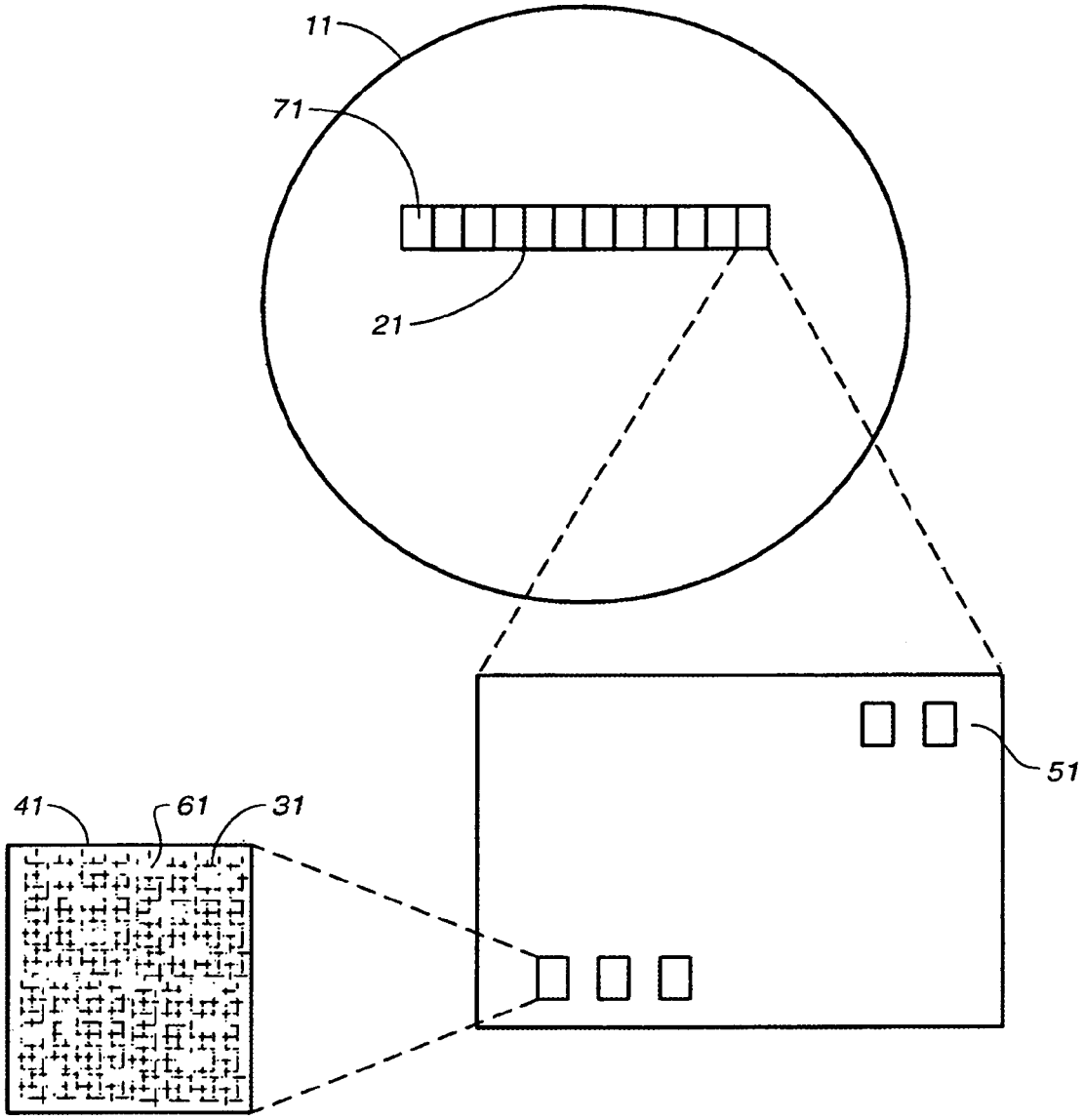
FIG. 1 is a schematic top view of a wafer with a row of integrated circuit dies.

Referring to FIG. 1, one or more dies 21, which include integrated circuits 71, are formed on the surface of a wafer 11. The wafer 11 can have multiple dies 21 on its surfaces, such as around 400 dies. The integrated circuits 71 located within each die 21 are made of copper features 31 that are isolated from one another by dielectric material 61. The copper features 31 are typically formed by etching a pattern into a dielectric material to form trenches, and then by filling in the trenches in the dielectric material 61 with copper. The region within the die 21 where the copper features 31 are dense provides an array 41, whereas areas of the die that are free of copper features 31 provide fields 51.

Figure 2:
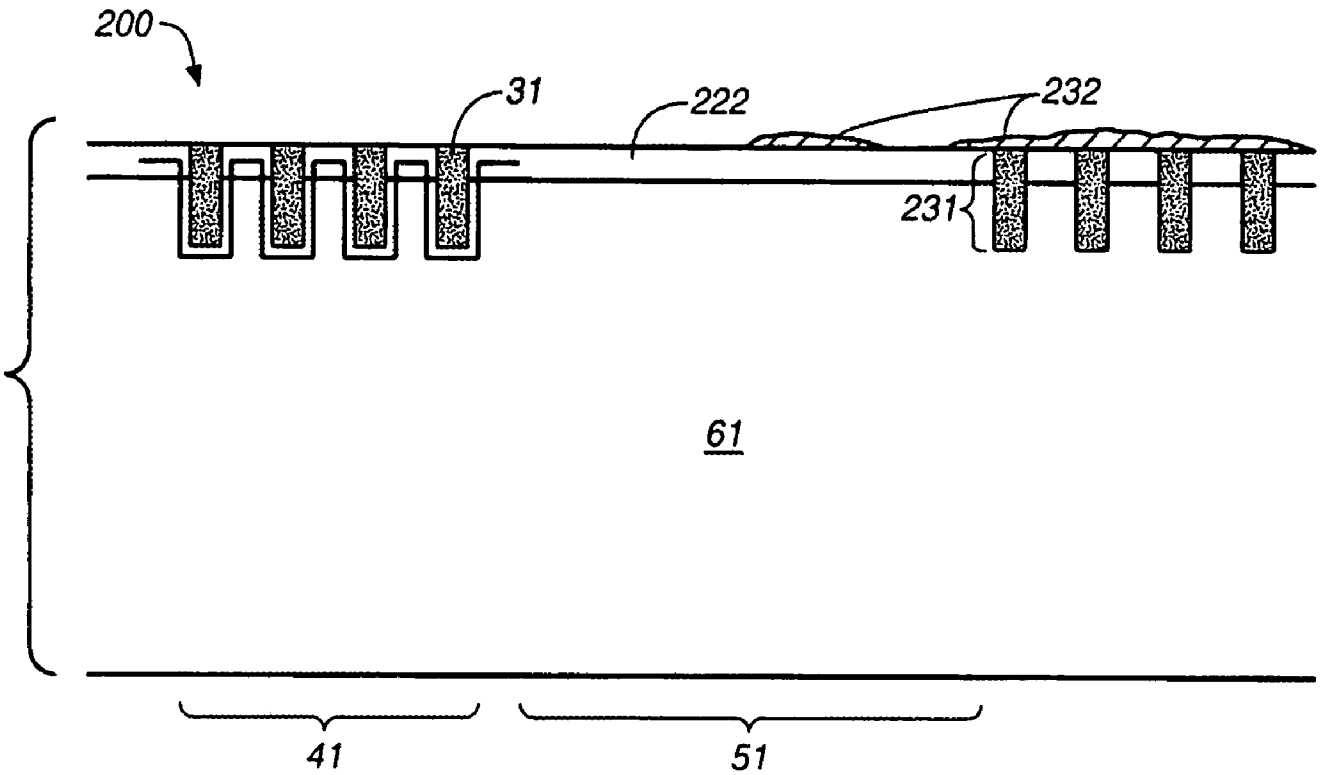
FIG. 2 is a schematic cross-sectional view of a portion of the wafer before the wafer enters the final stage of polishing.

Referring to FIG. 2, an incompletely polished wafer 200 has dielectric material 61 in the fields 51 and the arrays 41 and copper features 31 in the arrays 41. The wafer 200 will have some barrier material 222, such as TiN, TSiN, Ta, TaN, WN, WSiN, or another appropriate material, remaining. The wafer 200 can also have some copper residue 232 overlying the dielectric material 61, which is not a part of the copper features 31. The final polishing stage will remove the remaining copper residue 232 and barrier material residue 222 to complete this stage of wafer production.

Ideally, after polishing, the copper features 31 should be the maximum thickness possible without leaving any copper residue 232 or barrier material residue 222 between the copper features 31. If the wafer is underpolished, any copper residue 232 and barrier material residue 222 remaining on the dielectric material 61 in the array 41 and fields 51 contribute to current leakage in the integrated circuit. On the other hand, if the wafer is overpolished, a portion of the copper features 31 can be removed, resulting in reduced copper feature thickness 231 that can increase resistance and affect conductive uniformity within the wafer 200. For example, non-uniform polishing can be exhibited by the dies in the center being polished more than dies on the edge of the wafer.

Figure 3:
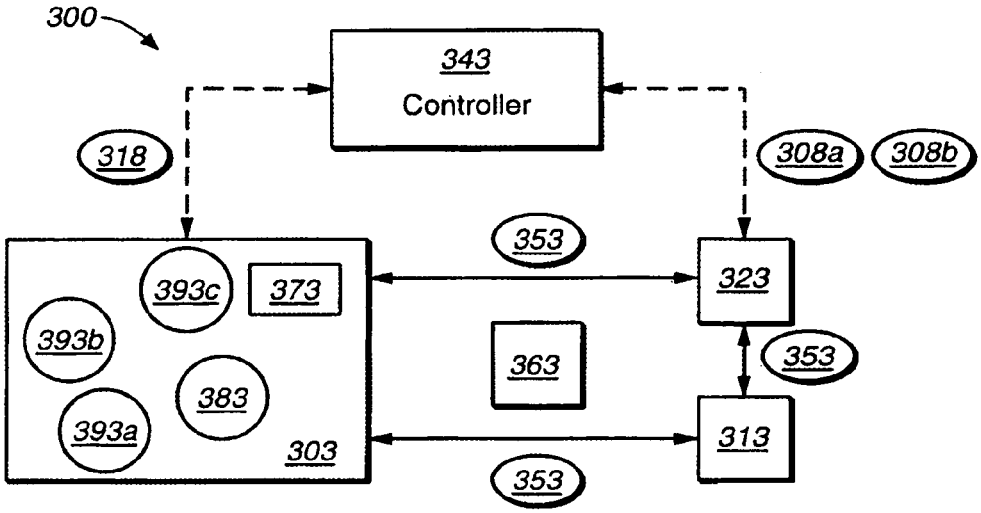
FIG. 3 is a schematic diagram of chemical mechanical polishing system.

Referring to FIG. 3, a CMP system 300 consists of a CMP station 303, a cassette storage unit 313, a metrology station 323, a robot 363, and a controller 343. A CMP system 300 can include other units, exist in a different configuration than the one depicted, or include different components that perform the same tasks as the components described. The robot 363 transfers wafers 353 to and from the cassette storage unit 313, the CMP station 303, and the metrology station 323. The CMP station 303 houses a transfer apparatus 383 and three polishing stations 393*a*, 393*b*, 393*c*. Typically, each polishing station includes a rotatable platen bearing a polishing pad. Of course, although the CMP station 303 depicted houses three polishing stations 393*a*, 393*b*, 393*c*, it can have a different number of polishing stations. The CMP station 303 also can house a cleaner 373.

There are numerous methods of moving wafers through the CMP system 300. One possible method is for the robot 363 to take an unpolished wafer 353 from cassette storage 313 and transfer it to the transfer apparatus 383 of the CMP station 303. The transfer apparatus 383 aids in moving the wafer 353 from one polishing station 393*a*, 393*b*, 393*c* to the next polishing station 393*a*, 393*b*, 393*c*. Typically, by loading the wafer into a carrier head that is movable between the transfer station and the platens each polishing station 393*a*,

393*b*, 393*c* can have different parameters and conditions for polishing the wafer 353. The polishing parameters can include, but are not limited to, polishing time, slurry composition, slurry dispensing rate, polishing pad composition, rotational speed of the platen, rotational speed of the carrier head, polishing temperature, and carrier head pressure. After the wafer 353 has been polished on each of the polishing stations 393*a*, 393*b*, 393*c* it is moved to the cleaner 373 where the wafer 353 is cleaned. The cleaner 373 can also be a separate apparatus from the CMP station 303. A description of a similar system for polishing and cleaning wafers 353 can be found in U.S. Pat. No. 6,413,145, the entire disclosure of which is incorporated herein by reference.

The robot 363 then can transfer the wafer 353 to and from the metrology station 323. The metrology station 323 has the ability to measure one or more properties of the wafer, such as the thicknesses T1, T2 of the dielectric material in the arrays 41 and in the fields 51, respectively. The measurements 308*a*, 308*b*, of thicknesses T1, T2, respectively, can be stored or output to another station in the CMP system 300. The metrology station 323 can also have the ability to measures the thickness T3 of other materials, such as the copper residue 232 or barrier material residue 222 on the wafer 353. An example of two suitable metrology stations 323 are the NovaScan 2020 for 200 mm wafers and the NovaScan 3030 for 300 mm wafers, both available from Nova Measuring Devices, Ltd., of Rehovot, Isreal. Once the measurements 308*a*, 308*b*, 308*c* of the thicknesses T1, T2, T3 are performed, the wafer 353 can be transferred back to the cassette storage unit 313 by the robot 363.

The measurements 308*a*, 308*b*, 308*c* taken by the metrology station 323 are sent to the controller 343. The controller 343 is a programmable computer that uses the measurements 308*a*, 308*b*, 308*c* to calculate polishing parameters 318, or recipes, for at least one of the multiple polishing stations 393*a*, 393*b*, 393*c*. The controller 343 can communicate the polishing parameters 318 to the CMP station 303. The controller 343 can perform calculations of the polishing parameters 318 using a data-based model, as described in U.S. patent application Ser. No. 60/396,755, filed Jul. 19, 2002, the entire disclosure of which is incorporated herein by reference. The controller 343 can alternatively or additionally communicate with each of the polishing stations 393*a*, 393*b*, 393*c*. The controller 343 can be one device or multiple devices that calculate and communicate with the CMP station 303 or with each of the polishing stations 393*a*, 393*b*, 393*c*. The polishing parameters 318 replace or supplement previous parameters and are used on a subsequent wafer 354 in a lot of wafers that move through the CMP system 300. A lot of wafers may include wafers that have been similarly processed, wafers with the same pattern of features, wafers with the same dielectric material, wafers that have been processed together within a particular time frame, or another series of wafers that may be grouped together. Often a single lot of wafers includes 25–50 wafers. Only the wafers 354, 355, 356, 357 that have not been completely polished can be affected by the post-polishing measurements 308*a*, 308*b*, 308*c* taken from a polished wafer 353.

Figure 4:
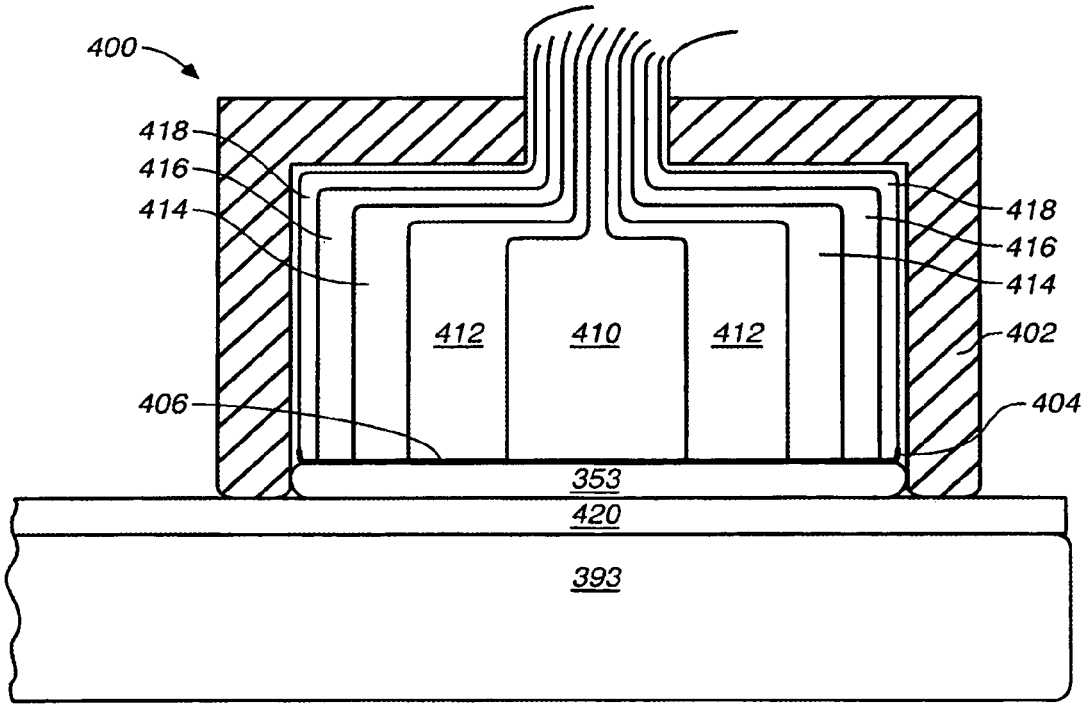
FIG. 4 is a schematic cross-sectional diagram of a carrier head.

Referring to FIG. 4, a carrier head 400 includes a retaining ring 402 and multiple concentric annual chambers 410, 412, 414, 416, 418 above a flexible membrane 406. During the polishing process, the carrier head 400 is located at a polishing station 393 and holds a wafer 353 in place against the polishing pad 420. A more detailed description of a suitable carrier head can be found in U.S. patent application Ser. No. 09/712,389, filed Nov. 13, 2000, the entire disclosure of which is incorporated herein by reference.

Typically, the flexible membrane 406 applies pressure to the wafer 353. Moreover, the pressure applied to the wafer 353 can be adjusted by increasing or decreasing the pressure in annular concentric chambers 410, 412, 414, 416, 418 located above the flexible membrane 406. These chambers 410, 412, 414, 416, 418 allow different pressures to be applied to different radial zones of the wafer 353. To assist in keeping the wafer 353 in place during polishing, the carrier head 400 has a retaining ring 420, which encircles the flexible membrane 406 and chambers 410, 412, 414, 416, 418 keeping the wafer 353 within the ring's inner boundary 404.

Figure 5A:
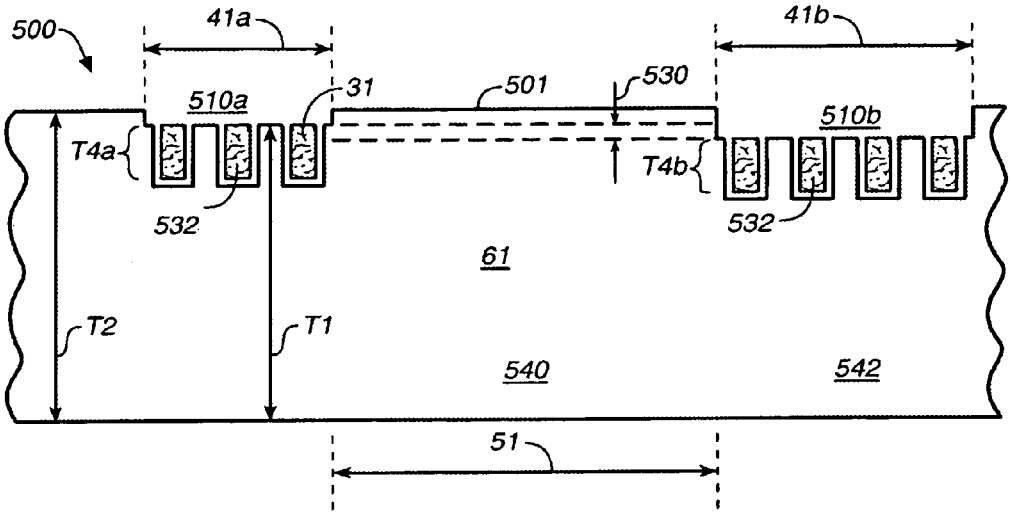
FIG. 5*a* is a schematic of a profile of a wafer depicting erosion.

Referring to FIG. 5*a*, portions of the surface 501 of a wafer 500 exhibit areas of erosion 510*a*, 510*b* and irregularity as the wafer 353 is polished. Erosion is loss of thickness T1 of the dielectric material 61 and the thickness T4 of copper features 31 in the arrays 41 due to polishing. The polishing process does not polish the wafer 353 to perfect planarity for a variety of reasons. One reason for the nonplanar surface is that the wafer 353 is not planar before it is brought to the CMP station 303. In forming the copper features, the deposition of copper on a patterned dielectric material surface creates a nonplanar surface. This initial nonplanar surface is then polished with pads that can be imperfect, slurry that can be unevenly distributed, or pressure that can be applied unevenly, along with other physical variables that cause uneven wafer 353 polishing.

At the final polishing station 393*c*, a non-selective polishing slurry can be used to polish the wafer. Although the slurry is non-selective, the polishing at the final station 393*c* typically polishes away the arrays 41 at a faster rate than the fields 51. This disparate polishing rate is because the arrays 41 offer less structural support for the polishing pad 420 than the fields 51. The polishing pad 420 therefore polishes away the copper features 31 and dielectric material 61 in the arrays 41 more quickly than the dielectric material 61 in the fields 51 of the wafer 500. This irregular polishing rate contributes to localized areas of erosion 510*a*, 510*b*.

As discussed above, simultaneous goals in wafer polishing are to ensure uniform thickness T4 of the copper features 31 across the substrate, to prevent the thickness T4 of the copper features from falling below a minimum thickness, such as by minimizing erosion, and to eliminate any exposed barrier material residue 222 on the dielectric material 61 of the wafer 500. However, the goals of eliminating exposed barrier material residue 222 and maintaining copper feature 532 thickness are at odds with one another. As the barrier material residue 222 is polished away, erosion 510*a*, 510*b* of the copper features 532 begins. Generally, the more the wafer is polished, the greater the erosion 510*a*, 510*b* and greater the differences in thickness T4*a*, T4*b* of the copper features 532 from one array 41*a* to another array 41*b*, respectively. A contributing factor to differences in the thickness T4 of the copper features 532 is that each pattern of the copper features 532 erode at different rates, because width, density and quantity of the copper features 532 in an array affects the rate of erosion. Greater erosion differences result in reduced uniformity of the thickness T4 of copper features 31 in a wafer 500. Some amount of controlled erosion 510 of the copper features 532 may be acceptable, if differences 530 in the thicknesses T4*a*, T4*b* of the copper features 532 from one array 41*a* to another array 41*b*, respectively, can be reduced. The uniformity of the thickness T4 of the copper features 532 should be maintained wafer-to-wafer as well as within the wafer 500. To maintain uniformity of the thickness T4 of the copper features 532, the polishing of the wafer 500 should be controlled so that exposed barrier material residue 222 is removed, yet polishing is stopped before erosion 510*a*, 510*b* becomes nonuniform and too severe.

Figure 6:
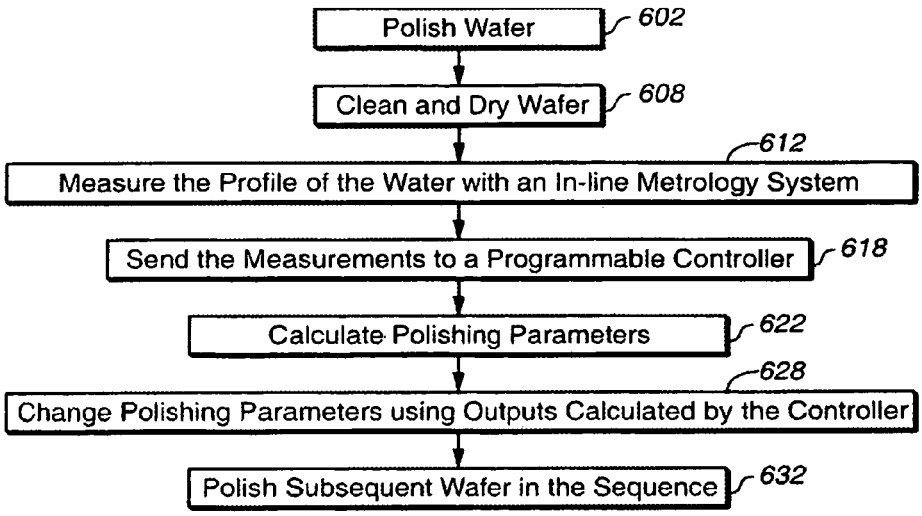
FIG. 6 is a flow chart illustrating a process of controlling erosion and residue in chemical mechanical polishing of a wafer.

Referring to FIG. 6, the controller 343 can perform a closed-loop control process in which data from inline metrology measurements 308*a*, 308*b*, 308*c* of a first wafer are used to affect the processing of subsequent wafers, such as in a lot of wafers. Initially, a first wafer is polished at the CMP station 303 (step 602). The wafer is then cleaned and dried (step 608). The clean and dry wafer is delivered to the inline metrology system 323, and the metrology system 323 measures the profile of the wafer 535, such as the thickness T1 of the dielectric material 61 in the array 41 of the wafer 353, as well as the thickness T2 of any dielectric material 61 in the field 51 of the wafer 353 and the thickness T3 of any barrier material 61 or copper residue 232 on the wafer 353 (step 612). The metrology station 323 can measure various radial points across the surface of the wafer. In one implementation, each die across the surface of the wafer 353 is measured at a particular position. Of course, other measurements can be taken.

The purpose of obtaining these measurements 308*a*, 308*b*, 308*c* is to determine the profile of the polished wafer 353. The goal is to polish the wafer so that the wafer has a planar surface with uniform thickness T4 of the copper features 532, minimal erosion and little to no barrier material residue 222 or copper residue 232. A benefit of a planar wafer is that subsequent layers of copper features 31 can be fabricated on a wafer's surface 501. Another benefit of a planar wafer 353 is the maintenance of uniform thickness T4 of the copper features 532. Thickness T4 of the copper feature 532 is proportional (although not necessarily linearly proportional) to the conductivity. Therefore, conductivity can be controlled by controlling the thickness T4 of the copper features 532 of the integrated circuits 71. The greater thickness T4 the copper feature 532 has, the higher the conductivity and lower the resistance the integrated circuit 71 has. As the copper features 532 are polished, the thickness T4 of the features 532 reduces, resulting in an integrated circuit with higher resistance. Continued polishing also reduces uniformity between the thickness T4 of copper features 532 at different arrays 41 on the wafer 500, adversely affecting conductive uniformity.

The inline metrology station 323 can measure the thickness T2, T1 of the field dielectric material 540 and the array dielectric material 542, respectively, after polishing to obtain array dielectric material measurements 308*a* and field dielectric material measurements 308*b*. The inline metrology station 323 may also measure the thickness of any residue 232 or barrier material residue 222. One approach to determining whether the copper features 532 have been uniformly polished is to measure the erosion 510 in multiple arrays 41 across the wafer. Erosion can be measured as the difference between the thickness T2 of field dielectric material 540 and the thickness T1 of the array dielectric material 542, i.e. T2–T1. This method of indirectly measuring thickness T4 of copper features 532 is reliable if the wafer 353 is planar and the dielectric fields 51 on the wafer 353 are of uniform thickness across the wafer.

However, as stated above, the wafers 353 are not planar. Therefore, the thickness T2 of the field dielectric material 540 in one field can differ from thickness T2 of the field dielectric material 540 in another field. Consequently, two arrays with equal erosion need not have equal thickness T4 of copper features 532 if the fields used to find the erosion values are of different thickness. In short, uniformity of erosion does not necessarily indicate uniformity of thickness T4 of copper features 532. A polishing control system that only uses the calculation T2–T1 of the erosion 510*a*, 510*b* in the arrays 41 may be unable to achieve a uniform and consistent thickness T4 of copper features 532, and therefore may produce nonuniform conductivity from wafer-to-wafer and within wafers.

Figure 5B:
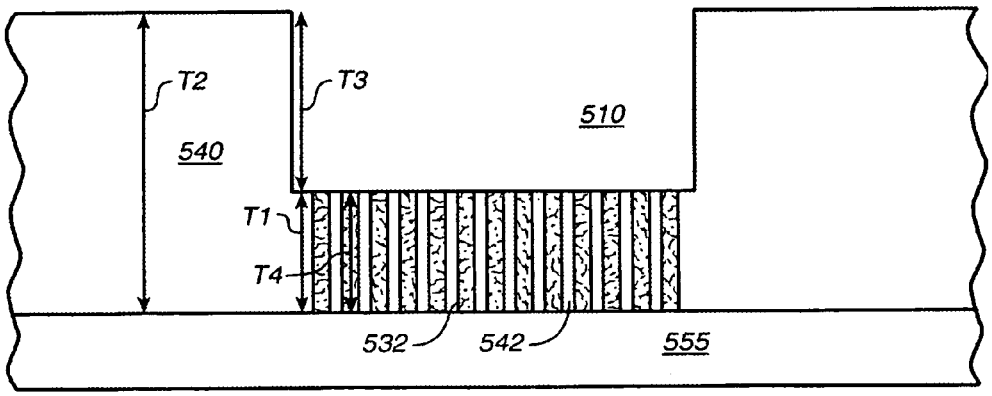
FIG. 5*b* is a schematic of a profile of a wafer depicting erosion where the dielectric layer is formed on an etch stop layer.

One solution is to use the measurements 308*a* of the thickness T1 of the array dielectric material 542 and compare the measurements 308*a* across the surface of the wafer. Assuming the copper features 532 are fabricated on a planar surface, the thickness T1 of the array dielectric material 542 is proportional to the thickness T4 of copper features 532. In some wafers, the thickness T1 of the array dielectric material 542 equals the thickness T4 of copper features 532, as shown in FIG. 5*b*. The thickness T1 of the array dielectric material 542 is typically equal to the thickness T4 of copper features 532 when an etch stop layer 555 is just below the dielectric material. Another solution includes using the measurement 308*d* of erosion at various points across the wafer.

An advantage to using the thickness T1 of the array dielectric material 542 is that the relationship between thickness T1 of the array dielectric material 542 and thickness T4 of copper features 532 remains reliable even if there are variations in polishing across the wafer 500. This measuring method is not dependent on thickness T2 of the field dielectric material 540 as to nonplanar wafer polishing. By measuring and controlling the thickness T1 of the array dielectric material 542, the thickness T4 of copper features 532 can be measured. Because the thickness T4 of copper features 532 is proportional to conductivity, controlling the thickness T1 of the array dielectric material 542 can also control conductivity.

The measurements 308*a*, 308*b*, 308*c* made by the inline metrology system 323 are then sent to the programmable controller 343 (step 618). The difference between the thickness T2 of the field dielectric material 540 and the thickness T1 of the array dielectric material 542 provides a measurement 308*d* of erosion. If the measurement 308*d* of erosion is not an input in the calculation, the measurement 308*d* of erosion can either be sent to the controller 343, or calculated by the controller 343. Generally, a target value for the thickness T1 of the array dielectric material 542 is entered into the controller 343.

The controller 343 is programmed with an algorithm that uses and the measurement 308*a* of the thickness T1 of the array dielectric material 542, and in some cases the barrier material residue or copper residue measurements 308*c* and the measurement 308*d* of erosion, to determine the optimal polishing parameters for simultaneously removing the barrier material residue 222, maintaining uniform thickness T4 of the copper features 532 and minimizing erosion. A software program, such as a program resident on the controller 343, uses the algorithm to calculate the polishing parameters 318 from at least the measurement 308*a* of the array dielectric material 542. The polishing parameters are calculated to approximate an optimal solution, subject to other constraints, in which the predicted uniformity of the dielectric layer thickness is maximized (step 622). The optimal solution can also attempt to minimize the predicted erosion is minimized or minimize the difference between a predicted metal feature thickness and a target metal feature thickness. Examples of other constraints that can be used in the calculation can include limitations on the polishing parameters, such as a maximum or minimum pressure that can be placed on the wafer, or maximum or minimum speeds at which the wafer is rotated on the polishing pad, and limitations from predicted substrate characteristics, such as the desired overall wafer planarity, or the target dielectric material thickness. In approximating the optimal solution, the system may attempt to calculate polishing parameters that approximate an optimal solution for some or all of these other predicted substrate characteristics.

Some examples of the polishing parameters include: polishing time, slurry composition, slurry dispensing rate, polishing pad composition, rotational speed of the platen, rotational speed of the carrier head, polishing temperature, and carrier head pressure. Calculating the polishing parameters 318 can involve solving formulas or using look up tables that have been created from experimental results. Assuming the controller 343 uses a data-based model, the array dielectric material measurements 308*a* provide inputs that should improve the reliability of the model to generate polishing profiles that achieve a uniform thickness T4 of the copper features 532, minimize erosion and uniformly remove the exposed barrier material residue 222 and copper residue 232. Several optimal solutions may exist for any combination of inputs. Absolute minimum erosion and uniform barrier material residue removal may not necessarily be achieved with any one or more polishing parameters 318.

Once the measurements 308*a*, 308*b*, 308*c*, 308*d* have been input into the algorithm and the polishing parameters 318 have been calculated, these parameters 318 are used to replace or supplement the previously used polishing parameters at the CMP station 303 (step 628). The revised polishing parameters are used to polish the next wafer in the polishing sequence (step 632). This closed loop control of the CMP station 303 using newly calculated polishing parameters 318 allows control of the conductivity and the conductivity profile of the wafers 354, 355, 356, 357. Adjusting the parameters maintains uniform conductivity from one wafer to another in the sequence, as well as improving the within wafer conductivity from one die to the next in each subsequently polished wafer.

Figure 7:
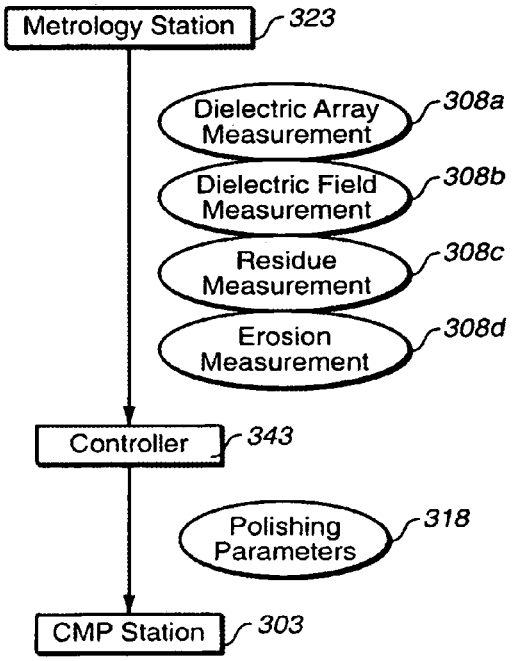
FIG. 7 is a block diagram of the flow of data through a CMP system.

An example of closed loop control of the CMP station 303 for a first wafer that has uniform erosion across the wafer, an overpolished center and an outer edge that still has barrier material residue 222 remaining follows. The flow of data in the CMP system is also described, as shown in FIG. 7. The inline metrology station 323 measures thickness T3 of the barrier material residue 222 and residue 232, thickness T2 of the field dielectric material 540 and thickness T1 of the array dielectric material 542 at multiple points along a radius on the surface of the wafer 353 to provide measurements 308*a*, 308*b*, 308*c*. In one implementation, the erosion (T2–T1) is calculated by the metrology station, and the measurement 308*b* and 308*c* are sent to the controller with the erosion measurement 308*d*. In another implementation, the measurements 308*a*, 308*b* and 308*c*, are, respectively, sent to the controller 343, and erosion measurement 308*d* is calculated by the controller 343. In a third implementation, all four of the measurements 308*a*, 308*b*, 308*c* and 308*d*, are sent from the metrology station to the controller 343.

The controller 343 calculates polishing parameters 318. The polishing parameters are sent to the CMP station 303. If the polishing parameters 318 are different from the previously used polishing parameters, the CMP station 303 uses the updated polishing parameters 318. Amongst other controllable parameters, the pressure in the chamber 410 that is in contact with the center of the wafer 354 can be reduced and the polishing time extended for a subsequent wafer 354. The subsequent wafer 354 that is polished will exhibit a more uniform profile across the wafer 354.

In another implementation, the in-line metrology station 323 can include a metrology system that directly measures the copper layer thickness in the die, e.g., in the array, circuit, or bond pad. For example, an acousto-optical metrology systems, such as the Impulse, available from PANalytical (formerly Philips Analytical) in Almelo, the Netherlands, the MX30, available from Applied Materials, Inc., in Santa Clara, Calif., or the Meta-PULSE, available from Rudolph Technologies in Flanders, N.J. The metrology station can also measure barrier material residue and copper residue that remains on the copper features, field dielectric material and array dielectric material.

After polishing, multiple measurements of the metal layer thickness (e.g., at a spot in an array) are made for dies at different radial positions on the wafer. These metal layer thickness measurements are sent to the controller 343 as inputs. The controller 343 calculates polishing parameter 318 that should result in uniform metal layer thickness and removal of barrier material residue 222 and copper residue 232, and sends the polishing parameters to the CMP station 303.

A number of implementations of the invention have been described. Nevertheless, it will be understood that various modifications may be made without departing from the spirit and scope of the invention. For example, some systems can measure the copper feature thickness indirectly by measuring dielectric material thickness from the bottom of the copper features to the top of the wafer, even when the dielectric material thickness in the array is greater than the thickness of the copper features. Accordingly, other embodiments are within the scope of the following claims.

What is claimed is:

1. A method for closed loop control in chemical mechanical polishing using an inline metrology station, comprising:

measuring, at a metrology station, a dielectric thickness in an array for each of a plurality of arrays of a first wafer of a plurality of wafers;

determining at least one polishing parameter from the measured dielectric thicknesses so that a uniformity of metal feature thicknesses is increased with subsequent polishing, the determining being based on a model in which a thickness of a metal feature in an array is proportional to a dielectric thickness in the array; and polishing a subsequent wafer from the plurality of wafers using the polishing parameter.

2. The method of claim 1, further comprising:

measuring a dielectric thickness in a field of the first wafer.

3. The method of claim 2, wherein:

determining the at least one polishing parameter includes using the dielectric thickness in the field of the first wafer.

4. The method of claim 2, further comprising:

determining a measurement of erosion, where the measurement of erosion is a difference between the dielectric thickness in the field and the dielectric thickness in the array; and wherein determining the at least one polishing parameter includes using the measurement of erosion.

5. The method of claim 1, wherein:

determining the at least one polishing parameter includes approximating an optimal solution under a plurality of constraints with reference to which a predicted metal feature thickness uniformity is maximized in a subsequent wafer from the plurality of wafers.

6. The method of claim 1, further comprising:
passing the dielectric thickness measurement to a controller.

7. The method of claim 6, further comprising:
passing the polishing parameters to a chemical mechanical polishing apparatus.

8. The method of claim 1, further comprising:
measuring barrier layer residue thickness and determining the at least one polishing parameter from the dielectric thickness and the barrier layer residue thickness.

9. The method of claim 1, wherein:
determining the polishing parameter includes using the measurement of dielectric thickness in the array to approximate an optimal solution under a plurality of constraints with reference to which a predicted copper feature thickness uniformity is maximized and a difference between a predicted copper feature thickness and a target copper feature thickness is minimized.

10. The method of claim 1, wherein:
the polishing parameter includes at least a polishing time or a pressure of a chamber in a carrier head.

11. A method for closed loop control in chemical mechanical polishing using an inline metrology station, comprising:
measuring at a metrology station metal feature thicknesses at multiple points across a first wafer wherein the first wafer is one of a plurality of wafers;
calculating at least one polishing parameter using the measurements of the metal feature thicknesses of the first wafer that approximates an optimal solution under a plurality of constraints with reference to which a predicted metal feature thickness uniformity is maximized in a subsequent wafer from the plurality of wafers; and
polishing the subsequent wafer from the plurality of wafers using the at least one polishing parameter.

12. The method of claim 11, wherein:
measuring includes measuring with an acousto-optical metrology device.

13. The method of claim 11, wherein:
measuring includes measuring with a non-contact optical metrology device.

14. The method of claim 11, wherein:
measuring includes measuring the metal feature thicknesses in a plurality of dies at different radial positions from a center of the wafer.

15. The method of claim 11, wherein:
the plurality of constraints includes minimization of a predicted erosion in a subsequent wafer.

16. The method of claim 11, wherein:
measuring the metal feature thicknesses includes measuring copper feature thicknesses.

17. The method of claim 11, wherein:
the at least one polishing parameter includes a polishing time or a pressure of a chamber in a carrier head.

18. A method for closed loop control in chemical mechanical polishing using an inline metrology station, comprising:
measuring a first dielectric thickness in a first array of a first wafer at a metrology station;
measuring a second dielectric thickness in a second array of the first wafer at the metrology station;
passing the first and second dielectric thicknesses from the metrology station to a controller;
operating the controller to determine at least one polishing parameter from the measured dielectric thicknesses so that a uniformity of metal feature thicknesses is increased with subsequent polishing, the determining being based on a model in which a thickness of a metal feature in an array is proportional to a dielectric thickness in the array; and
polishing a subsequent wafer with the at least one polishing parameter.

19. A method for closed loop control in chemical mechanical polishing using an inline metrology station, comprising:
measuring at a metrology station metal feature thicknesses at multiple points across a first wafer wherein the first wafer is one of a plurality of wafers;
calculating at least one polishing parameter using the measurements of the metal feature thicknesses of the first wafer that approximates an optimal solution under a plurality of constraints with reference to which a difference between a predicted metal feature thickness and a target metal feature thickness is minimized; and
polishing a subsequent wafer from the plurality of wafers using the at least one polishing parameter.

20. A method for closed loop control in chemical mechanical polishing using an inline metrology station, comprising:
measuring, at a metrology station, a metal feature thickness in an array for each of a plurality of arrays of a first substrate of a plurality of substrates;
determining at least one polishing parameter from the measured dielectric thicknesses so that a uniformity of metal feature thicknesses is increased with subsequent polishing, the determining being based on a model in which a thickness of a metal feature in an array is proportional to a dielectric thickness in the array; and
polishing a subsequent substrate from the plurality of substrates using the polishing parameter.

21. The method of claim 19, wherein:
measuring includes measuring with an acousto-optical metrology device.

22. The method of claim 19, wherein:
measuring includes measuring with a non-contact optical metrology device.

23. The method of claim 19, wherein:
measuring includes measuring the metal feature thicknesses in a plurality of dies at different radial positions from a center of the wafer.

24. The method of claim 19, wherein:
the plurality of constraints includes minimization of a predicted erosion in a subsequent wafer.

25. The method of claim 19, wherein:
measuring the metal feature thicknesses includes measuring copper feature thicknesses.

26. The method of claim 19, wherein:
the at least one polishing parameter includes a polishing time or a pressure of a chamber in a carrier head.

* * * * *